US008769984B2

(12) United States Patent
Itou et al.

(10) Patent No.: US 8,769,984 B2
(45) Date of Patent: Jul. 8, 2014

(54) DECOMPRESSION DEVICE

(75) Inventors: Tetsuya Itou, Kariya (JP); Teruyuki Hotta, Kariya (JP); Atsushi Inaba, Okazaki (JP)

(73) Assignee: Denso Corporation, Kariya (JP)

( * ) Notice: Subject to any disclaimer, the term of this patent is extended or adjusted under 35 U.S.C. 154(b) by 867 days.

(21) Appl. No.: 12/928,912

(22) Filed: Dec. 22, 2010

(65) Prior Publication Data

US 2011/0154853 A1 Jun. 30, 2011

(30) Foreign Application Priority Data

Dec. 24, 2009 (JP) ..... 2009-292849

(51) Int. Cl.
*F25B 41/06* (2006.01)

(52) U.S. Cl.
CPC ..... *F25B 41/06* (2013.01); *F25B 2341/062* (2013.01)
USPC ..... 62/528; 62/527

(58) Field of Classification Search
CPC ..... F25B 41/062; F25B 41/065; F25B 2341/062; F25B 2341/061; F25B 2341/064
USPC ..... 62/527–528
See application file for complete search history.

(56) References Cited

U.S. PATENT DOCUMENTS

| | | | | |
|---|---|---|---|---|
| 6,532,764 | B1 | 3/2003 | Hirota et al. | |
| 2001/0027657 | A1 | 10/2001 | Yamasaki et al. | |
| 2004/0036044 | A1 * | 2/2004 | Hirota | 251/30.02 |
| 2006/0219965 | A1 * | 10/2006 | Hirota | 251/30.02 |

* cited by examiner

*Primary Examiner* — Cassey D Bauer
(74) *Attorney, Agent, or Firm* — Harness, Dickey & Pierce, PLC

(57) ABSTRACT

A decompression device includes an upstream throttle portion, a middle passage portion and a downstream throttle portion, which are arranged within a body portion. The upstream throttle portion is a variable throttle including an upstream throttle passage in which the refrigerant is decompressed and expanded, and a valve body having an open degree adjusting portion configured to adjust an open degree of the upstream throttle passage. The downstream throttle portion is a fixed throttle for decompressing and expanding refrigerant flowing from the middle passage portion. Furthermore, a refrigerant passage defined from the upstream throttle portion to the downstream throttle portion through the middle passage portion is provided in the body portion, and is bent at least at a bent portion in which the refrigerant flow is bent in the body portion.

9 Claims, 8 Drawing Sheets

DECOMPRESSION DEVICE

CROSS REFERENCE TO RELATED APPLICATION

This application is based on Japanese Patent Application No. 2009-292849 filed on Dec. 24, 2009, the contents of which are incorporated herein by reference in its entirety.

FIELD OF THE INVENTION

The present invention relates to a decompression device for a refrigerant cycle.

BACKGROUND OF THE INVENTION

In a conventional air conditioner for a vehicle, a receiver-type refrigerant cycle is provided. In the receiver-type refrigerant cycle, refrigerant flowing out of a radiator is separated in a receiver into gas refrigerant and liquid refrigerant, and the separated liquid refrigerant is stored in the receiver as a surplus refrigerant of the refrigerant cycle. In the receiver-type refrigerant cycle, a thermal expansion valve is used as a decompression device, and a refrigerant flow amount is automatically controlled such that a superheating degree of refrigerant at a refrigerant outlet of an evaporator is maintained at a predetermined value.

The thermal expansion valve is provided with a block-shaped body portion forming an outer shell. The block-shaped body portion has therein a refrigerant passage through which high-pressure refrigerant flows, a throttle passage for decompressing and expanding the high-pressure refrigerant, and a refrigerant passage through which the refrigerant flowing out of the evaporator flows. Furthermore, a temperature sensing rod, a valve body and the like are disposed in the body portion of the thermal expansion valve. Furthermore, an element is disposed outside of the body portion to be displaced in accordance with temperature and pressure of the refrigerant flowing out of a refrigerant outlet of the evaporator. Generally, the thermal expansion valve is called as a box-type expansion valve.

In contrast, in an accumulator-type refrigerant cycle, an accumulator is disposed between a refrigerant outlet side of an evaporator and a refrigerant suction side of a compressor, to separate the refrigerant into gas refrigerant and liquid refrigerant and to store the separated liquid refrigerant. In the accumulator-type refrigerant cycle, a supercooling degree of refrigerant at a refrigerant outlet of a condenser is maintained to a suitable range (e.g., 7-15° C.), thereby increasing a cycle efficiency.

For example, in Patent document 1 (JP Patent No. 3757784B2 corresponding to US 2001/0027657), a refrigerant flow amount is controlled while the supercooling degree of refrigerant at a refrigerant outlet side of a condenser is maintained in a suitable range, thereby increasing cycle operation efficiency even when cycle operation condition is changed in a wide range.

In the Patent document 1, a decompression device is provided with a variable throttle located at a refrigerant upstream side, and a fixed throttle located at a refrigerant downstream side. In the fixed throttle with a nozzle shape, a variation in the refrigerant flow amount is large when the dryness x of the refrigerant is small (for example, $0<x<0.1$), and thereby a flow amount adjustment gain is large. In view of the above point, in the decompression device of the Patent document 1, the supercooling refrigerant at the refrigerant outlet side of the condenser is decompressed by the variable throttle at the refrigerant upstream side such that the refrigerant decompressed by the variable throttle is changed in the small dryness range, and the gas-liquid two-phase refrigerant flows into the fixed throttle to be decompressed again.

Thus, the fixed throttle can perform a refrigerant flow amount adjustment in a refrigerant state with a large adjustment gain. Accordingly, even when the operation condition of the refrigerant cycle is changed, the refrigerant flow amount can be adjusted in a wide range by the small variation range of the supercooling degree. Therefore, the supercooling degree of the refrigerant at the refrigerant outlet of the condenser can be maintained in a suitable range in which the cycle operation efficiency can be increased, and thereby the cycle operation can be performed with a high efficiency.

However, in the decompression device of the Patent document 1, because the variable throttle and the fixed throttle are arranged on the same straight line, the dimension of a refrigerant tube in the axial direction becomes larger, and it is difficult for the refrigerant tube to be disposed in the block-shaped body portion.

When the decompression device of the Patent document 1 is used in the accumulator-type refrigerant cycle instead of the box-shaped expansion valve that is generally known, the decompression device is required to be mounted into a refrigerant pipe or to be connected between refrigerant pipes. In this case, it is necessary to greatly change the specifications of other components (e.g., air conditioning unit (HVAC) or joint) of the air conditioner. Therefore, a production cost increases due to a design change or/and production facility change or the like.

The present invention is made in view of the above matters, and it is an object of the present invention to provide a decompression device, which can be suitably used for an accumulator-type refrigerant cycle without greatly changing the specification of other components generally used in a refrigerant cycle, while improving the cycle operation efficiency.

It is another object of the present invention to provide a decompression device which can be easily adapted to a refrigerant cycle while improving the cycle operation efficiency.

According to an aspect of the present invention, a decompression device for decompressing a high-pressure refrigerant of a refrigerant cycle includes a body portion having a block shape; an upstream throttle portion provided in the body portion at an upstream side of a refrigerant flow; a middle passage portion provided in the body portion at a downstream side of the upstream throttle portion such that the refrigerant having passed through the upstream throttle portion flows through the middle passage portion; and a downstream throttle portion arranged as a fixed throttle in the body portion at a downstream side of the middle passage portion such that the refrigerant having passed through the middle passage portion flows into the downstream throttle portion. In the decompression device, the upstream throttle portion is a variable throttle including an upstream throttle passage in which the refrigerant is decompressed and expanded, and a valve body having an open degree adjusting portion configured to adjust an open degree of the upstream throttle passage, and a refrigerant passage defined from the upstream throttle portion to the downstream throttle portion through the middle passage portion is provided in the body portion and is bent at least at a bent portion in which the refrigerant flow is bent in the body portion.

In the above decompression device, because the upstream throttle portion configured by a variable throttle and the downstream throttle portion configured by a fixed throttle are used, the cycle operation efficiency can be improved. Furthermore, because refrigerant passage defined from the upstream throttle portion to the downstream throttle portion through the middle passage portion is provided in the body portion and is bent at least at the bent portion in which the refrigerant flow is bent in the body portion, the size of the body portion, in which the upstream throttle portion, the downstream throttle portion and the middle passage portion are arranged, can be effectively reduced. Furthermore, the decompression device can be easily used instead of a conventional box-shaped expansion valve. Thus, it is possible for the other components of a receiver-type refrigerant cycle to be adapted to an accumulator-type refrigerant cycle, without greatly changing the specifications of the other components.

For example, the upstream throttle portion may include an upstream throttle passage in which the refrigerant is decompressed and expanded, and a valve body having an open degree adjusting portion configured to adjust an open degree of the upstream throttle passage. Furthermore, the upstream throttle portion may be configured by a variable throttle having a valve chamber in which the valve body is slidably accommodated, the valve body may be provided with a partition portion that divides the valve chamber into an inlet-side pressure chamber and a middle-side pressure chamber, the inlet-side pressure chamber may be provided to communicate with an inlet side refrigerant passage and the upstream throttle passage so that the refrigerant from the inlet side refrigerant passage flows into the upstream throttle passage through the inlet-side pressure chamber, the middle-side pressure chamber may communicate with the middle passage portion through a pressure equalization portion such that the refrigerant flows into the middle-side pressure chamber from the middle passage portion, and the valve body may be configured to cause the partition portion to be displaced in accordance with a pressure difference between the inlet-side pressure chamber and the middle-side pressure chamber, so that the open degree adjusting portion adjusts the open degree of the upstream throttle passage. Accordingly, even when the upstream throttle portion, the middle passage portion and the downstream throttle portion are not arranged on the same straight line, the upstream throttle portion can be configured as a differential pressure valve in which the throttle open degree is changed in accordance with a pressure difference between its upstream side and its downstream side.

Furthermore, the decompression device may be provided with a downstream throttle-passage forming member defining therein a downstream throttle passage in which the refrigerant is decompressed and expanded. In this case, the downstream throttle-passage forming member may be attached to the body portion to configure the downstream throttle portion. Alternatively, the body portion may directly form therein a downstream throttle passage in which the refrigerant is decompressed and expanded, thereby configuring the downstream throttle portion.

The body portion may be attached to an attachment member to be attached, the attachment member may include a protruding portion protruding to the body portion, and the body portion may have therein an insertion hole at a downstream side of the middle passage portion. In this case, the protrusion portion of the attachment member is inserted into the insertion hole of the body portion, the protrusion portion of the attachment member has therein a refrigerant passage through which the refrigerant flowing out of the middle passage portion flows in a state where the protrusion portion is inserted into the insertion hole, the refrigerant passage provided in the protrusion portion has a protrusion-side throttle passage in which the refrigerant is decompressed and expanded, and the downstream throttle portion is configured by the protrusion-side throttle passage.

A film seal member may be disposed in the valve chamber at a side of the middle-side pressure chamber of the valve body to seal the inlet-side pressure chamber and the middle-side pressure chamber from each other, and a support member may be disposed to contact an outer peripheral portion of the seal member on a side of the middle-side pressure chamber, and may be fixed to the body portion. In this case, the seal member is inserted between the body portion and the support member.

Alternatively, a circular seal member may be disposed between an inner peripheral wall surface of the body portion defining the valve chamber and an outer peripheral surface of the valve body, to be elastically deformable. In this case, the seal member seals the inlet-side pressure chamber and the middle-side pressure chamber from each other.

The valve body may be divided into a first valve portion and a second valve portion in a sliding direction. In this case, a film seal member may be disposed between the first valve portion and the second valve portion to seal the inlet-side pressure chamber and the middle-side pressure chamber from each other.

Furthermore, a spring may be disposed in the middle-side pressure chamber to apply a load to the valve body in a direction closing the upstream throttle passage. In this case, an adjustment screw may be disposed in the body portion to adjust the load due to the spring. Alternatively, a spring receiving member may be disposed in the body portion to support an end portion of the spring at a side opposite to the valve body.

BRIEF DESCRIPTION OF THE DRAWINGS

Other objects, features and advantages of the present invention will become more apparent from the following description made with reference to the accompanying drawings, in which like parts are designated by like reference numbers and in which.

EMBODIMENTS

Figure 1:
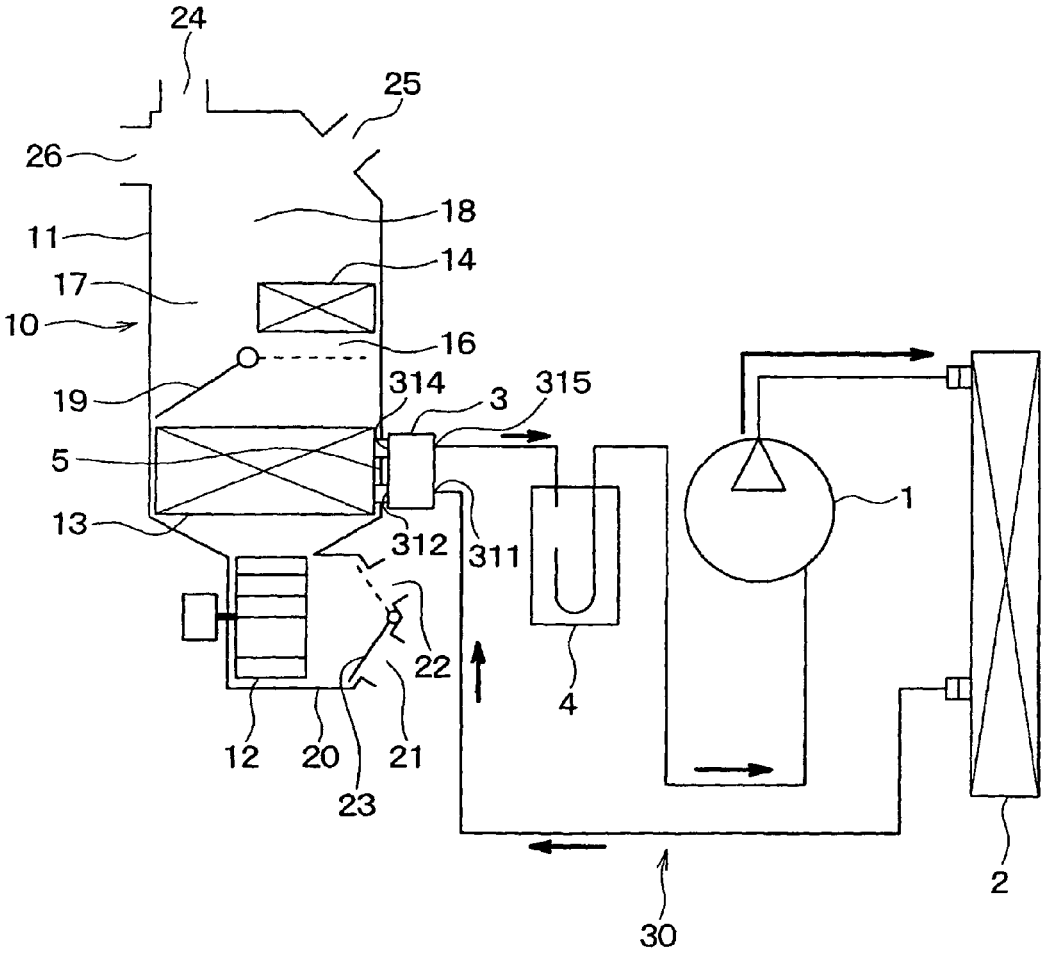
FIG. 1 is a schematic diagram showing an air conditioner for a vehicle including a refrigerant cycle with a decompression device according to a first embodiment of the invention.

Embodiments for carrying out the present invention will be described hereafter referring to drawings. In the embodiments, a part that corresponds to a matter described in a preceding embodiment may be assigned with the same reference numeral, and redundant explanation for the part may be omitted. When only a part of a configuration is described in an embodiment, another preceding embodiment may be applied to the other parts of the configuration. The parts may be combined even if it is not explicitly described that the parts can be combined. The embodiments may be partially combined even if it is not explicitly described that the embodiments can be combined, provided there is no harm in the combination.

(First Embodiment)

FIG. 1 is a schematic diagram showing an air conditioner for a vehicle including a refrigerant cycle with a decompression device 3 according to a first embodiment. The air conditioner of the present embodiment has an interior air conditioning unit 10 shown in FIG. 1. The interior air conditioning unit 10 is located inside of an instrument panel (i.e., dash panel) positioned at the frontmost portion in a vehicle compartment. The interior air conditioning unit 10 includes an air conditioning casing 11 forming an outer shell and defining an air passage. In the air conditioning casing 11, a blower 12, an evaporator 13, a heater core 14 and the like are disposed.

The casing 11 defines the air passage through which air flows into the vehicle compartment. The casing 11 is made of a resin (e.g., polypropylene) having a suitable elasticity and being superior in the strength. An inside/outside air switching box 20 is located at the most upstream side to selectively introduce inside air or/and outside air into the casing 11. Hear, inside air is air inside the vehicle compartment, and outside air is air outside the vehicle compartment.

More specifically, the inside/outside air switching box 20 is provided with an inside air introduction port 21 for introducing inside air into the casing 11, and an outside air introduction port 22 for introducing outside air into the casing 11. An inside/outside air switching door 23 is disposed in the inside/outside air switching box 20 to continuously adjust open areas of the inside air introduction port 21 and the outside air introduction port 22. Therefore, the inside/outside air switching door 23 can adjust a ratio between a flow amount of inside air (i.e., air inside the vehicle compartment) introduced from the inside air introduction port 21 and a flow amount of outside air (i.e., air outside the vehicle compartment) introduced from the outside air introduction port 22. The inside/outside air switching door 23 is driven by an actuator such as servo motor.

The blower 12 is disposed in the casing 31 at a downstream air side of the inside/outside air switching box 20, to blow air drawn via the inside/outside air switching box 20 toward the interior of the vehicle compartment. The blower 12 is an electrical blower in which a centrifugal multi-blade fan (sirocco fan) is driven by an electric motor.

The evaporator 13 is disposed in the casing 11 at a downstream air side of the blower 12 to cross all the air passage area in the casing 11. The evaporator 13 is a cooling heat exchanger in which the refrigerant passing therein is heat-exchanged with air blown by the blower 12 to cool the blown air. The evaporator 13 is one component in a refrigerant cycle 30. The refrigerant cycle 30 includes a compressor 1, a condenser 2, a decompression device 3 and an accumulator 4, in addition to the evaporator 13.

The compressor 1 is arranged in an engine compartment, and performs suction, compression and discharge of refrigerant in the refrigerant cycle 30. The compressor 1 is driven by a driving force from an engine (not shown) via an electromagnetic clutch or the like.

The condenser 2 is arranged in the engine compartment. Outside air sent from a blower fan is heat-exchanged with refrigerant in the condenser 2, so that the compressed refrigerant discharged from the compressor 1 is cooled and condensed in the condenser 2.

For example, the condenser 2 includes a heat-exchanging core portion (not shown) and a tank portion (not shown) exchanging horizontally at upper and lower two sides of the heat-exchanging core portion. The heat-exchanging core portion includes a plurality of tubes (not shown) extending in a top-bottom direction. Refrigerant that is an example of a heat exchange fluid flows in the tubes to be cooled and condensed by outside air.

The decompression device 3 decompresses liquid refrigerant condensed in the condenser 2 to be in a gas-liquid two-phase state. The decompression device 3 is configured such that refrigerant is throttled and decompressed in two-steps in the refrigerant flow direction.

The evaporator 13 is adapted to evaporate the decompressed refrigerant by performing heat exchange between refrigerant and air. The accumulator 4 is a gas-liquid separator, in which the refrigerant flowing out of the evaporator 13 is separated into gas refrigerant and liquid refrigerant, and surplus liquid refrigerant in the cycle is stored in the accumulator 4. A refrigerant suction port of the compressor 1 is connected to a gas refrigerant outlet of the accumulator 4.

The evaporator 13 is disposed in the casing 11, and the heater core 14 is disposed in the casing 11 at a position downstream of the evaporator 13. In the casing 11, there is provided with a first air passage 16 through which air after passing through the evaporator 13 flows into the heater core 16, a second air passage 17 through which air after passing through the evaporator 13 bypasses the heater core 16, and a mixing space 18. Air flowing through the first air passage 16 and air flowing through the second air passage 17 are mixed in the mixing space 18 so that conditioned air having a desired temperature can be obtained.

In the first air passage 16, the heater cores 14 arranged, so that air dehumidified and cooled by the evaporator 13 flows through the heater core 14 through the first air passage 16. The heater core 14 is a heating heat exchanger configured to perform heat exchange between engine coolant (hot water) heated by heat of a vehicle engine and air after passing through the evaporator 13. Thus, the heat core 14 heats air after passing through the evaporator 13 in the first air passage 16.

On the other hand, cool air having passed through the evaporator 13 flows into the mixing space 18 through the second air passage 17 used as the cool air bypass passage while bypassing the heater core 14. Thus, the temperature of air (i.e., conditioned air) mixed in the mixing space 18 is changed by adjusting a ratio between a flow amount of air passing through the first air passage 16 and a flow amount of air passing through the second air passage 17.

In the present embodiment, an air mix door 19 is located downstream of the evaporator 13 at an inlet side of the first and second air passages 16, 17, so as to continuously change an air flow ratio flowing into the first and second air passages 16, 17.

Furthermore, at the most downstream air side, the casing 11 is provided with plural air outlets 24, 25, 26 from which conditioned air of the mixing space 18 is blown into the vehicle compartment that is a space to be air-conditioned. The air outlets 24, 25, 26 are, for example, a face air outlet 24 through which conditioned air is blown toward an upper side of a passenger in the vehicle compartment, a foot air outlet 25 through which conditioned air is blown toward the foot area of the passenger in the vehicle compartment, and a defroster air outlet 26 through which conditioned air is blown toward an inner surface of a windshield of the vehicle.

Next, the configuration of the decompression device 3 according to the present embodiment will be described.

Figure 2:
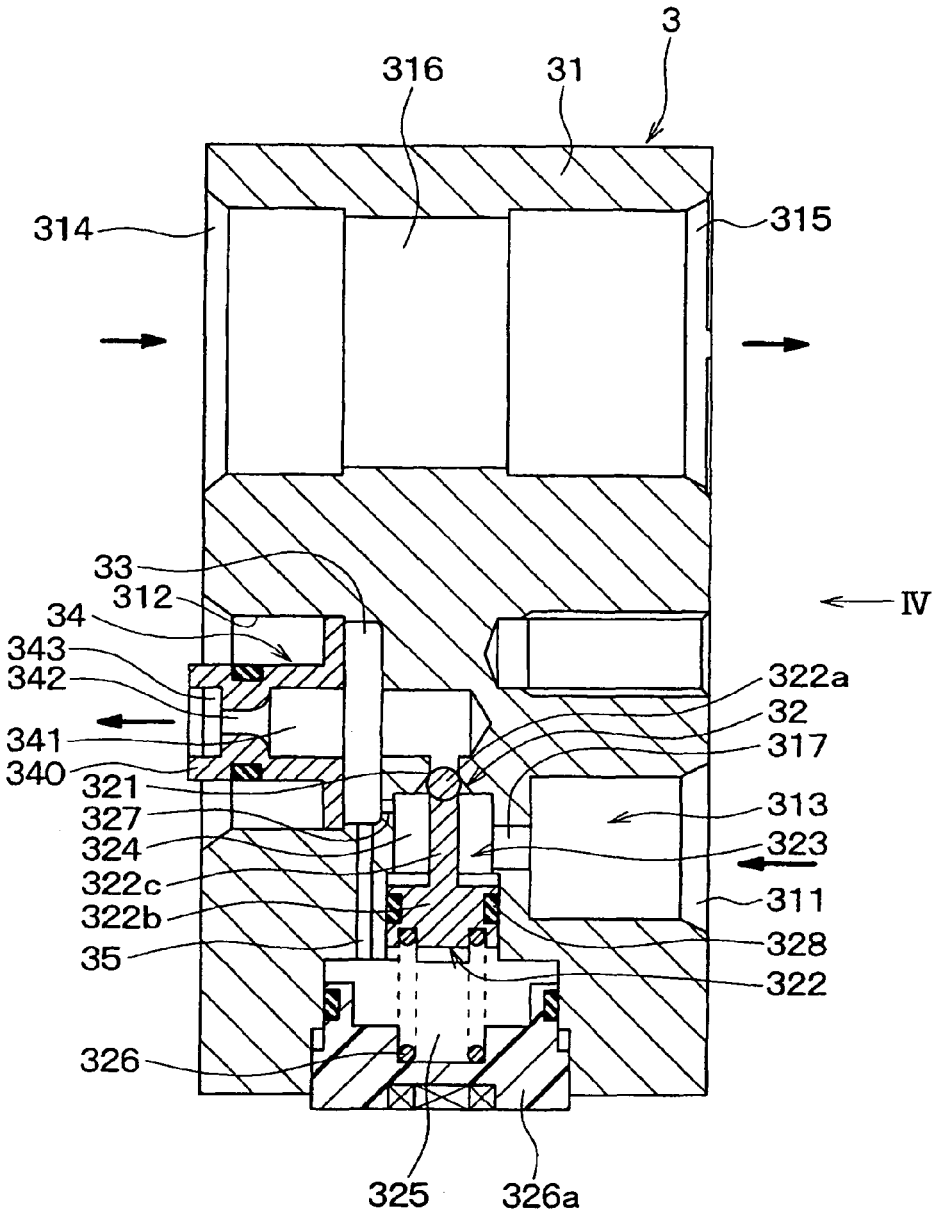
FIG. 2 is a sectional view showing the decompression device according to the first embodiment.

FIG. 2 is a sectional view showing the decompression device 3 according to the first embodiment. As shown in FIG. 2, the decompression device 3 is provided with a body portion 31, an upstream throttle portion 32, a middle passage portion 33, a downstream throttle portion 34, a pressure equalization portion 35 and the like.

The body portion 31 is formed in a block shape, and constitutes the outer shell of the decompression device 3, and a refrigerant passage in the decompression device 3, etc. Specifically, the body portion 31 is produced by forming holes in a prismatic or cylindrical block member made from a metal (e.g., aluminum). For example, in the present embodiment, the body portion 31 is provided with refrigerant inlet and outlet 311-316, an inlet side refrigerant passage 317 and the like.

More specifically, the body portion 31 is provided with a first inlet 311 from which a high-pressure refrigerant flowing out of the condenser 2 flows therein, and a first outlet 312 from which the refrigerant flowing therein from the first inlet 311 is discharged to a refrigerant inlet side of the evaporator 13. Therefore, a first refrigerant passage 313 is formed by a refrigerant passage extending from the first inlet 311 to the first outlet 312.

Furthermore, the body portion 31 is provided with a second inlet 314 from which low-pressure refrigerant flowing out of a refrigerant outlet of the evaporator 13 flows therein, and a second outlet 315 from which the refrigerant flowing therein from the second inlet 314 is discharged to the refrigerant inlet side of the accumulator 4. Therefore, a second refrigerant passage 316 is formed by a refrigerant passage extending from the second inlet 314 to the second outlet 315.

As shown in FIG. 2, the first refrigerant passage 313 is provided with the inlet side refrigerant passage 317, the upstream throttle portion 32, the middle passage portion 33, and the downstream throttle portion 34. The inlet side refrigerant passage 317 is made to communicate with the first inlet 311 and the upstream throttle portion 32, so that the refrigerant flowing from the first inlet 311 flows into the upstream throttle portion 32. The upstream throttle portion 32 is a variable throttle which is configured to decompress and expand high-pressure refrigerant flowing from the inlet side refrigerant passage 317. The middle passage portion 33 is provided downstream of the upstream throttle portion 32 such that the refrigerant having passed through the upstream throttle portion 32 flows into the middle passage portion 33. The downstream throttle portion 34 is a fixed throttle provided downstream of the middle passage portion 33 such that the refrigerant flowing from the middle passage portion 33 is further decompressed and expanded in the downstream throttle portion.

The first refrigerant passage 313 is defined by a passage extending from the upstream throttle portion 32 to the downstream throttle portion 34 via the middle passage portion 33. The first refrigerant passage 313 is provided to have two bent portions in which a refrigerant, flow is bent. The upstream throttle portion 32, the middle passage portion 33 and the downstream throttle portion 34 are not arranged on the same straight line.

In the example of FIG. 2, the middle passage portion 33 is arranged at an upper side of the upstream throttle portion 32, the downstream throttle portion 34 is arranged at a left side of the middle passage portion 33. Thus, the refrigerant flowing from the first inlet 311 flows into the middle passage portion 33 after the flow of the refrigerant is bent approximately by 90 degrees at the upstream throttle portion 32, and the refrigerant flowing into the middle passage portion 33 flows into the downstream throttle portion 34 after the flow of the refrigerant is bent in the middle passage portion 33 approximately by 90 degrees. That is, the flow of the refrigerant is bent in two-steps in both the upstream throttle portion 32 and the middle passage portion 33. Thus, the upstream throttle portion 32 and the middle passage portion 33 are respectively adapted as bent portions.

Next, the configuration of the upstream throttle portion 32 according to the present embodiment will be described in detail.

The upstream throttle portion 32 is configured of an upstream throttle passage 321 adapted to decompress and expand the refrigerant, a valve body 322 having an open degree adjusting portion 322*a* adapted to adjust open degree of the upstream throttle passage 321, and a valve chamber 323 in which the valve body 322 is slidably accommodated.

The valve body 322 includes a partition portion 322*b* configured to partition the valve chamber 323 into an inlet-side pressure chamber 324 and a middle-side pressure chamber 325. The partition portion 322*b* is connected to the open degree adjusting portion 322*a* by using a connection portion 322*c*. As shown in FIG. 2, the open degree adjusting portion 322*a* is formed into a spheral shape, as an example.

The open degree adjusting portion 322*a*, the connection portion 322*c* and the partition portion 322*b* are continuously arranged in this order on one straight line, and are formed integrally from a metal material such as stainless steel. Furthermore, the arrangement direction of the open degree adjusting portion 322*a*, the connection portion 322*c* and the partition portion 322*b* is set in parallel with a sliding direction of the valve body 322.

The inlet-side pressure chamber 324 is arranged at a side of the upstream throttle passage 321 of the partition portion 322*b*. The inlet-side pressure chamber 324 is made to communicate with the inlet side refrigerant passage 317 and the upstream throttle passage 321, such that the refrigerant flows into the inlet-side pressure chamber 324 from the inlet side refrigerant passage 317.

A first connection portion of the inlet-side pressure chamber 324 connected with the inlet side refrigerant passage 317, and a second connection portion of the inlet-side pressure chamber 324 connected to the upstream throttle passage 321 are not arranged on one straight line. That is, the arrangement direction of the first connection portion is shifted from the arrangement direction of the second connection portion. Thus, the flow of the refrigerant flowing toward the upstream throttle portion 321 is bent in the inlet-side pressure chamber 324.

The middle-side pressure chamber 325 is formed by the partition portion 322*b*, on a side opposite to the upstream throttle passage 321 with respect to the partition portion 322*b*. One end of the pressure equalization portion 35 is connected to the middle passage portion 33, and the other end of the pressure equalization portion 35 is connected to the middle-side pressure chamber 325. The pressure equalization portion 35 is made to communicate with the middle passage portion 33 and the middle-side pressure chamber 325, such that the refrigerant flows from the middle passage portion 33 into the middle-side pressure chamber 325 through the pressure equalization portion 35. In the present embodiment, the pressure equalization portion 35 is a hole portion extending in a direction parallel with the sliding direction of the valve body 322.

Because the partition portion 322*b* of the valve body 322 is held slidably in the valve chamber 323, a clearance is formed in a sliding portion between the partition portion 322*b* and the valve chamber 323. In the present embodiment, an O-ring 328 made of a rubber material is disposed in the valve chamber 323, such that the partition portion 322*b* is slidably held in the valve chamber 323 via the O-ring 328. The O-ring 328 is a circular seal member, which is elastically deformable so as to prevent the refrigerant from leaking from the sliding portion between the partition portion 322*b* and the valve chamber 323. Because the O-ring 328 is provided, the inlet-side pressure chamber 324 and the middle-side pressure chamber 325 can be tightly sealed from each other.

A coil spring 326 is accommodated in the middle-side pressure chamber 325. The coil spring 326 is disposed to apply a load to the open degree adjusting portion 322*a* of the valve body 322, such that the valve body 322 is biased to a side closing the upstream throttle passage 321. The load due to the coil spring 326 can be adjusted by an adjustment screw portion 326*a*.

Thus, the surface of the partition portion 322*b* of the valve body 322 exposed to the inlet-side pressure chamber 324 is adapted as a pressure receiving surface portion to which the refrigerant pressure of the inlet-side pressure chamber 324 is received. Furthermore, the surface of the partition portion 322*b* of the valve body 322 exposed to the middle-side pressure chamber 325 is adapted as another pressure receiving surface portion to which the load of the coil spring 326 and the refrigerant pressure of the middle-side pressure chamber 325 are received. Because the partition portion 322*b* moves in accordance with a pressure difference between the inlet-side pressure chamber 324 and the middle-side pressure chamber 325, the open degree adjusting portion 322*a* formed integrally with the partition portion 322*b* also moves in accordance with a movement of the partition portion 322*b*, thereby changing the open degree of the upstream throttle passage 321.

The inlet-side pressure chamber 324 is connected to the middle passage portion 33 through a connection refrigerant port 327 (bleed port). As shown in FIG. 2, one end of the connection refrigerant port 327 is connected to the inlet-side pressure chamber 324, and the other end of the connection refrigerant port 327 is connected to the middle passage portion 33. Therefore, the inlet-side pressure chamber 324 communicates with the middle passage portion 33 through the connection refrigerant port 327. For example, the connection refrigerant port 327 is a bleed port that is formed by opening a slit hole having a diameter about 0.5-0.8 mm in the body portion 31 from a side of the middle passage portion 33.

Thus, when the upstream throttle passage 321 is fully closed by the open degree adjusting portion 322*a* of the valve body 322, refrigerant and oil can flow to the middle passage portion 33 from the inlet-side pressure chamber 324 through the connection refrigerant port 327. As a result, during a refrigerant cycle, operation with a small flow amount in which the refrigerant flow amount is increased to a predetermined small amount, the upstream throttle portion 32 can be made in a close state, that is, the fully close state of the upstream throttle passage 321 can be maintained, thereby preventing hunting of the upstream throttle portion 32.

The middle passage portion 33 is provided in the first refrigerant passage 313 between the upstream throttle portion 32 and the downstream throttle portion 34. A first connection portion of the upstream throttle passage 321 of the upstream throttle portion 32 connected to the middle passage portion 33, and a second connection portion of the downstream throttle portion 34 connected to the middle passage portion 33 are not arranged on one straight line. That is, the arrangement direction of the first connection portion is shifted from the arrangement direction of the second connection portion. Thus, the flow of the refrigerant from the upstream throttle portion 32 is bent in the middle passage portion 33. As shown in FIG. 2, the middle passage portion 33 is connected to one end of the pressure equalization portion 35 and one end of the connection refrigerant port 327.

A downstream throttle-passage forming member 340 forms therein a first downstream passage 341, a downstream throttle passage 342 and a second downstream passage 343. The downstream throttle-passage forming member 340 is attached to a first outlet 312 of the body portion 31, thereby forming the downstream throttle portion 34. That is, the downstream throttle-passage forming member 340 separately formed from the body portion 31 is attached to the body portion 31, thereby forming the downstream throttle portion 34 in the body portion 31.

The first downstream passage 341 of the downstream throttle portion 34 is made to communicate with the middle passage portion 33, such that the refrigerant flows into the first downstream passage 341 of the downstream throttle portion 34 from the middle passage portion 33. The downstream throttle passage 342 is formed into a nozzle shape, and is configured to decompress and expand the refrigerant flowing from the middle passage portion 33 via the first downstream passage 341. The second downstream passage 343 is provided such that the refrigerant decompressed and expanded in the downstream throttle passage 342 flows out of the decompression device 3 to an exterior. In the present embodiment, the second downstream passage 343 is made to communicate with an inlet side passage 51 within an attachment block 5 (attachment member) described later, such that the refrigerant decompressed and expanded in the downstream throttle passage 342 flows to the inlet side passage 51 of the attachment block 5.

As shown in FIG. 2, the upstream throttle portion 32, the middle passage portion 33 and the downstream throttle portion 34 are arranged within the single body portion 31 formed into a block shape.

Figure 3:
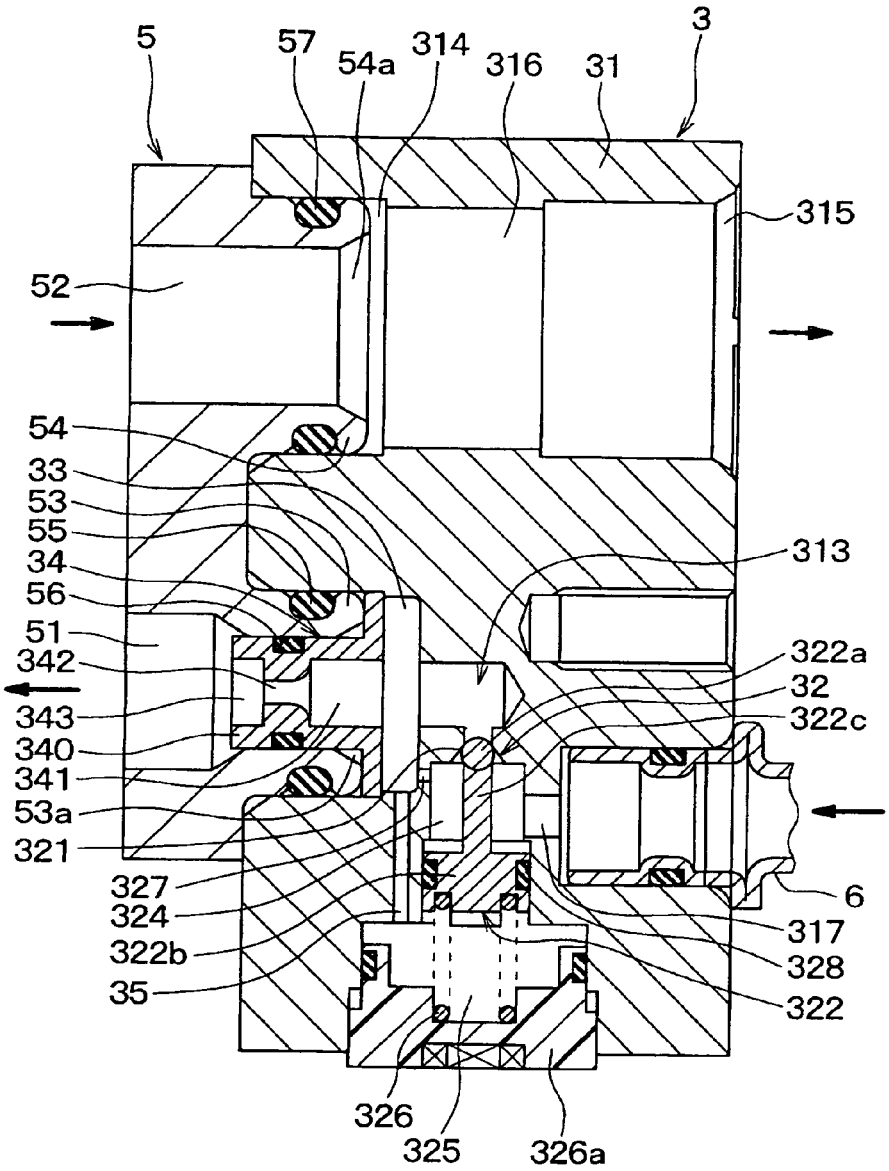
FIG. 3 is a sectional view showing an attachment state of the decompression device attached to an attachment block, according to the first embodiment.

FIG. 3 is a sectional view showing an attachment state of the decompression device 3 attached to the attachment block 5 of the present embodiment. As shown in FIG. 3, the decompression device 3 is attached to the attachment block 5 adapted as an attachment member to be attached. The attachment block 5 is formed into a block shape, and is attached to a tank portion of the evaporator 13.

The attachment block 5 is provided with the inlet side passage 51 as a first passage coupled to the evaporator 13, and an outlet side passage 52 as a second passage coupled to the evaporator 13. The inlet side passage 51 is connected to a refrigerant inlet side of the evaporator 13, such that the refrigerant decompressed and expanded in the decompression device 3 flows into the evaporator 13. The outlet side passage 52 is connected to a refrigerant outlet side of the evaporator 13, such that the refrigerant flowing out of the evaporator 13 flows into the outlet side passage 52. In the present embodiment, the inlet side passage 51 and the outlet side passage 52 are made in parallel in the refrigerant flow direction.

The attachment block 5 is provided with a first protrusion portion 53 and a second protrusion portion 54, which respectively protrude into the decompression device 3. The first protrusion portion 53 is inserted into the first outlet 312 of the decompression device 3 to be fitted with the first outlet 312 of the decompression device 53. An O-ring 55 is provided between the first protruding portion 53 and the first outlet 312, thereby sealing a space between the first protrusion portion 53 and the first outlet 312 by using the O-ring 55.

A first through hole 53*a* is formed in the first protruding portion 53, so that the downstream throttle-passage forming member 340 is inserted into and fitted with the first through hole 53*a* of the first protrusion portion 53. Therefore, the first through hole 53*a* forms a part of the inlet side passage 51. Thus, the second downstream passage 343 of the downstream throttle portion 34 of the decompression device 3 communicates with the inlet side passage 51 of the attachment block 5, so that the refrigerant decompressed and expanded at the downstream throttle passage 342 flows into the inlet side passage 51.

Furthermore, an O-ring 56 is provided between the downstream throttle-passage forming member 340 and the first through hole 53*a* of the first protrusion portion 53 of the attachment block 53. Therefore, the O-ring 56 seals a space between the downstream throttle-passage forming member 340 and the first throttle hole 53*a*.

The second protrusion portion 54 of the attachment block 5 is inserted into and fitted with the second inlet 314 of the decompression device 3. An O-ring 57 is provided between the second protruding portion 54 and the second inlet 314, thereby sealing a space between the second protrusion portion 54 and the second inlet 314 by using the O-ring 57.

A second through hole 54*a* is formed in the second protrusion portion 54, such that the second through hole 54*a* forms a part of the outlet side passage 52. Therefore, the outlet side passage 52 of the attachment block 5 communicates with the second refrigerant passage 316 of the decompression device 3, so that the refrigerant flowing out of the refrigerant outlet of the evaporator 13 flows into the second refrigerant passage 316 of the decompression device 3 through the outlet side passage 52 of the attachment block 5.

A pipe 6 is connected to the first inlet 311 of the decompression device 3, so that the decompression device 3 is connected to the condenser 2 shown in FIG. 1 by using the pipe 6.

Figure 4:
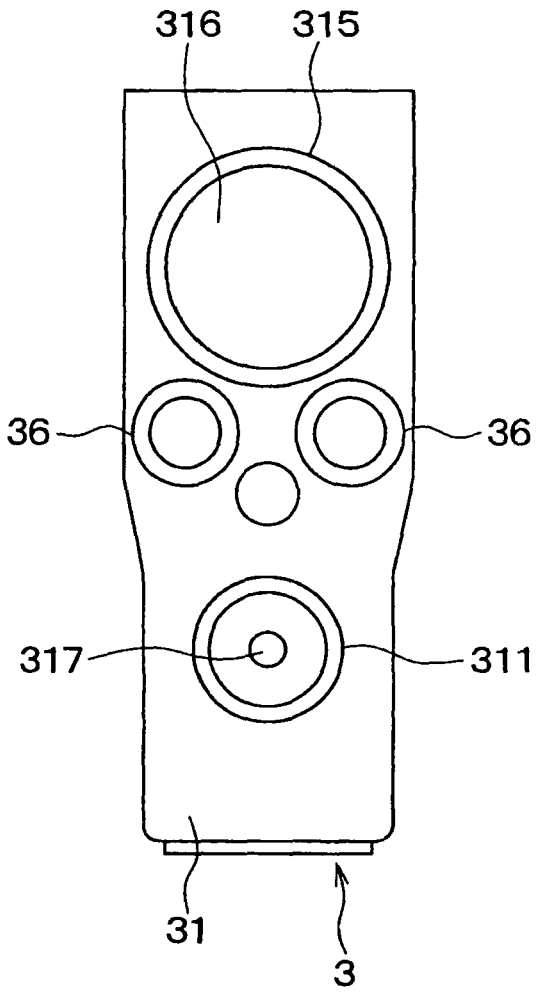
FIG. 4 is a side view of the decompression device when being viewed from the arrow of FIG. 2.

FIG. 4 is a side view when being viewed from the arrow IV of FIG. 2. As shown in FIG. 4, bolt holes 36 are provided in a surface portion of the body portion 31, in which the first inlet 311 and the second outlet 315 are formed. Bolts (not shown) are inserted into the bolt holes 36. In the present embodiment, in a state where the bolts are inserted into the bolt holes 36, the body portion 31 is fastened to the attachment block 5. Thus, the decompression device 3 is fixed to the attachment block 5.

According to the above-described decompression device 3 of the present embodiment, a bent portion, in which the refrigerant flow is bent, is provided in the first refrigerant passage 313 that is a refrigerant passage from the upstream throttle portion 32 to the downstream throttle portion 34 via the middle passage portion 33. Because the upstream throttle portion 32, the middle passage portion 33 and the downstream throttle portion 34 are not arranged on the same straight line, the size of the decompression device 3 can be reduced. The upstream throttle portion 32, the middle passage portion 33 and the downstream throttle portion 34 are provided in the interior of the single body portion 31 formed into a block shape. Therefore, it is possible to form the outer shape of the decompression device 3 to be the same shape as the outer shape of a conventional box-shaped expansion valve. Thus, the decompression device 3 can be used for an accumulator-type refrigerant cycle without greatly changing the specifications of other components, with respect to a receiver-type refrigerant cycle.

In addition, the pressure equalization portion 35 is provided so that the middle-side pressure chamber 325 of the upstream throttle portion 32 communicates with the middle passage portion 33 through the pressure equalization portion 35. Thus, even when the upstream throttle portion 32, the middle passage portion 33 and the downstream throttle portion 34 are not arranged on the same straight line, the upstream throttle portion 32 can be adapted as a differential pressure regulating valve in which a throttle open degree is changed in accordance with a pressure difference between its upstream side (i.e., the inlet-side pressure chamber 324) and its downstream side (i.e., middle passage portion 33).

The decompression device 3 of the present embodiment is provided with the upstream throttle portion 32 that is adapted as a variable throttle, and the downstream throttle portion 34 adapted as a fixed throttle, thereby configuring two-stage throttles in the decompression device 3. Therefore, the cycle operation efficiency can be improved in a refrigerant cycle in which the decompression device 3 is used.

In the downstream throttle portion 34 as the fixed throttle, a variation in the refrigerant flow amount is large when the dryness x of the refrigerant is small (for example, $0<x<0.1$), and thereby a flow adjustment gain is large. Thus, in the decompression device 3 of the present embodiment, the refrigerant at the refrigerant outlet side of the condenser 2 is decompressed by the upstream throttle portion 32 at the refrigerant upstream side such that the refrigerant is changed in the small dryness range, and then the gas-liquid two-phase refrigerant with a small dryness flows into the downstream throttle portion 34 to be decompressed again.

Thus, the downstream throttle portion 34 can perform a refrigerant flow adjustment in a refrigerant state with the large flow adjustment gain. According to the present embodiment, the upstream throttle portion 32 is adapted as the variable throttle. Therefore, the throttle open degree of the upstream throttle portion 32 can be adjusted in accordance with a variation in the refrigerant state at the outlet side of the condenser 2, while the dryness of the refrigerant flowing out of the decompression device 3 can be suitably adjusted based on the flow amount adjustment of the downstream throttle portion 34.

Accordingly, even when the operation condition of the refrigerant cycle is changed, the refrigerant flow amount can be adjusted in a wide range, while the supercooling degree of the refrigerant flowing out of the condenser 2 is changed in a small variation range. Therefore, the supercooling degree of the refrigerant at the refrigerant outlet of the condenser 2 can be maintained in a suitable range in which the cycle operation efficiency can be increased, and thereby the cycle operation can be performed with a high efficiency while cooling performance can be maintained.

Furthermore, the coil spring 326 is disposed in the middle-side pressure chamber 325 to apply a load to the valve body 322 in a direction for closing the upstream throttle passage 321, and the adjustment screw 326*a* is provided in the body portion 31 to adjust the load due to the coil spring 326. Thus, after the decompression device 3 is produced, it is possible to adjust the pressure difference for closing the upstream throttle passage 321 of the upstream throttle portion 32 by adjusting the load due to the coil spring 326.

(Second Embodiment)

Next, a second embodiment of the present invention will be described with reference to FIGS. 5A and 5B. In the second embodiment, the structure of the upstream throttle portion 32, the shape of the valve body 322 and the seal structure between the inlet-side pressure chamber 324 and the middle-side pressure chamber 325 are changed as compared with the above-described first embodiment.

Figure 5A:
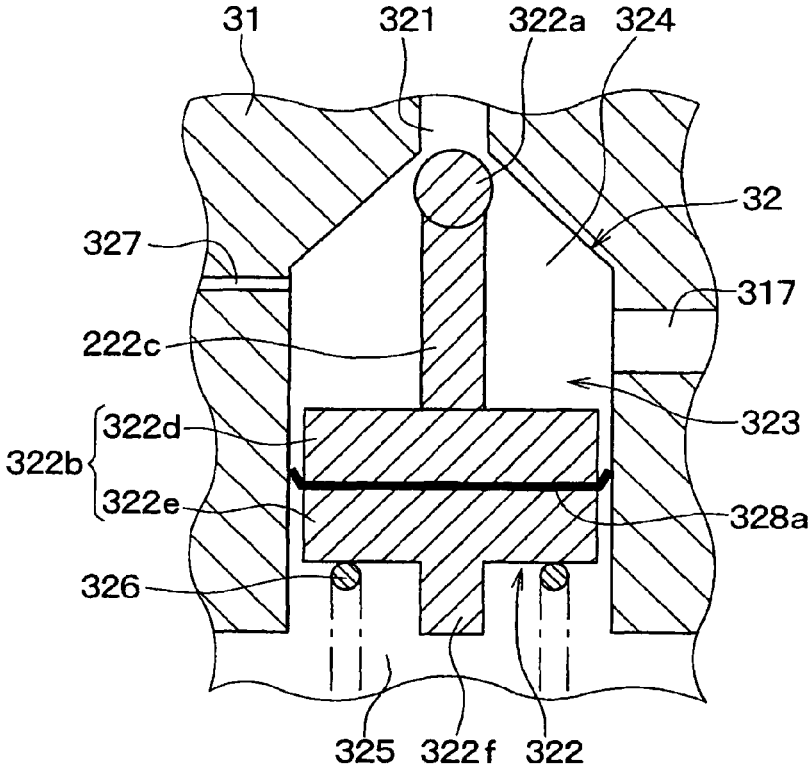
FIG. 5A is an enlarged sectional view showing an upstream throttle portion of a decompression device according to a second embodiment of the present invention.
Figure 5B:
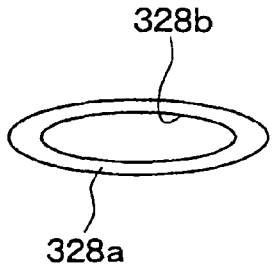
FIG. 5B is a perspective view showing a film of the decompression device according to the second embodiment.

FIG. 5A is an enlarged sectional view showing an upstream throttle portion 32 of a decompression device 3 according to the second embodiment of the present invention, and FIG. 5B is a perspective view showing a film 328*a* of the decompression device 3 according to the second embodiment.

As shown in FIGS. 5A and 5B, in the second embodiment, a partition portion 322*b* of the valve body 322 is divided into a first partition portion 322*d* and a second partition portion 322*e* in a sliding direction of the valve body 322. The first partition portion 322*d* is located at a side of the inlet-side pressure chamber 324, and the second partition portion 322*e* is located at a side of the middle-side pressure chamber 325.

As shown in FIG. 5A, a cylindrical valve chamber 323 is provided within the body portion 31, and the partition portion 322*b* is disposed in the valve chamber 323. A film 328*a* is provided as a film seal member between the first partition portion 322*d* and the second partition portion 322*e*. The film 328*a* is formed into a ring shape such as a doughnut shape to have a through hole 328*b* at a center portion of the film 328*a*, as shown in FIG. 5B. The outer diameter of the film 328*a* is set to be slightly larger than an inner diameter of the cylindrical valve chamber 323, so that all the outer peripheral end surface of the film 328*a* contacts the inner wall surface of the valve chamber 323. Because the film 328*a* is provided, the inlet-side pressure chamber 324 and the middle-side pressure chamber 325 can be tightly sealed from each other by using the film 328*a*.

A screw hole (not shown) is provided in the first partition portion 322*d* and the second partition portion 322*e* of the partition portion 322*b*, so that a screw 322*f* penetrates through the screw hole and is fitted into the screw hole of the partition portion 322*b*. The first partition portion 322*d* and the second partition portion 322*e* are joined with each other by the screw 322*f*, in a state where the partition portion 322*b* is inserted into the film 328*a*. Thus, the screw 322*f* is also inserted into the through hole 328*b* of the film 328*a*.

Because the thin film 328*a* is provided, the inlet-side pressure chamber 324 and the middle-side pressure chamber 325 can be tightly sealed from each other by using the film 328*a* with a simple structure. In the second embodiment, the other parts of the decompression device 3 may be similar to those of the decompression device 3 of the above-described first embodiment, and the effects of the above-described first embodiment can be obtained.

(Third Embodiment)

Next, a third embodiment of the present invention will be described with reference to FIG. 6. In the third embodiment, the structure of the upstream throttle portion 32, and the seal structure between the inlet-side pressure chamber 324 and the middle-side pressure chamber 325 are changed as compared with the above-described first embodiment.

Figure 6:
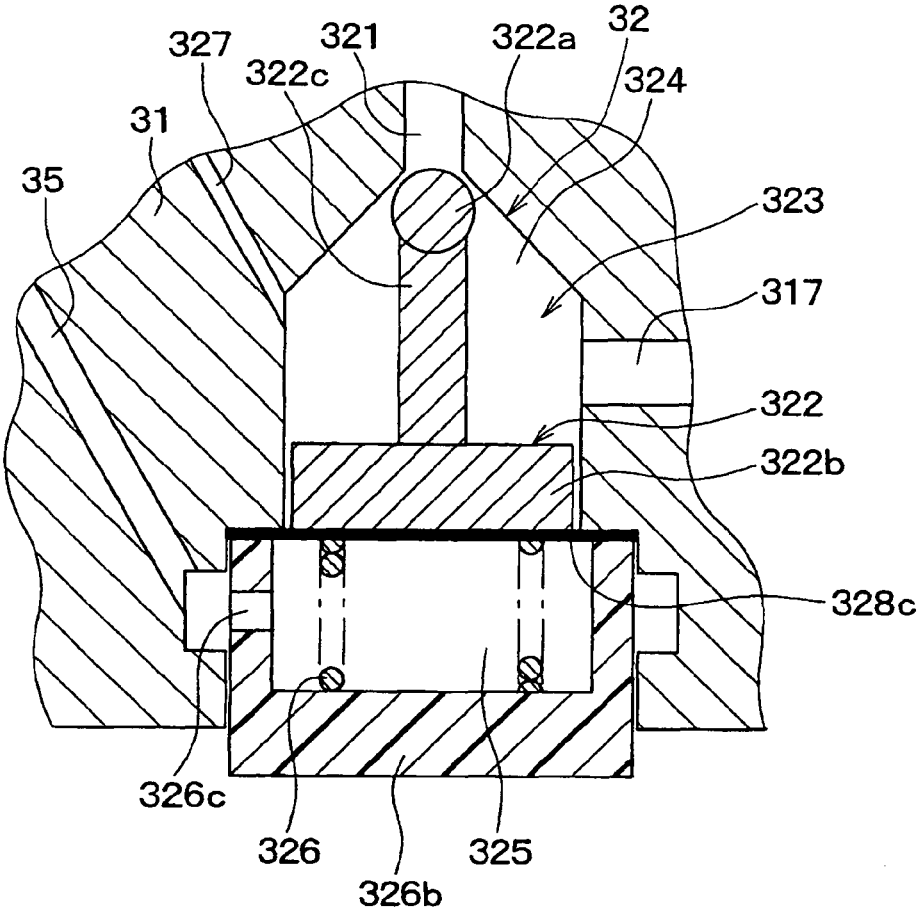
FIG. 6 is a sectional view showing an upstream throttle portion of a decompression device according to a third embodiment of the present invention.

FIG. 6 is a sectional view showing an upstream throttle portion 32 of a decompression device 3 according to a third embodiment of the present invention. As shown in FIG. 6, a film 328*c* is disposed as a film-like seal member in the valve chamber 323, at a side of the middle-side pressure chamber 325 in the valve body 322. In the example of FIG. 6, the film 328*c* is fixed in a state where the film 328*c* is inserted between the body portion 31 and an adjustment screw portion 326*b*. That is, the adjustment screw portion 326*b* of the present embodiment is adapted as a supporting member that contacts an outer peripheral portion of the film 328*c* on the surface exposed to the middle-side pressure chamber, 325, so that the film 328*c* is inserted between the adjustment screw portion 362*b* and the body portion 31 to be fixed therebetween.

A coil spring 326 is disposed to apply a load to the partition portion 322*b* via the film 328*c*. A through hole 326*c* is provided in the adjustment screw 326*b* such that the middle-side pressure chamber 325 communicates with the pressure equalization portion 35 through the through hole 326*c*.

In the decompression device 3 of the present embodiment, because the valve body 322 is set to be generally slidable only in a range of 0.5 to 1.0 mm, the film 328*c* is not broken by the slide movement of the valve body 322.

In the present embodiment, the film 328*c* is a thin film-like seal member, and is disposed to tightly seal the inlet-side pressure chamber 324 and the middle-side pressure chamber 325. Thus, sealing performance can be improved by using the film 328*c*. In the third embodiment, the other parts are similar to those of the above-described first embodiment, and the effects of the above-described first embodiment can be obtained.

(Fourth Embodiment)

Next, a fourth embodiment of the present invention will be described with reference to FIG. 7. In the fourth embodiment, a spring receiving member 326*d* is used, instead of the adjustment screw portion 326*a* in the above-described first embodiment. The spring receiving member 326*d* is a spring receiving plug fitted with the body portion 31. For example, a decompression device 3 of the present embodiment may be applied to a case where it is unnecessary to adjust a set differential pressure for opening the upstream throttle passage 321 of the upstream throttle portion 32 after the decompression device 3 is manufactured.

Figure 7:
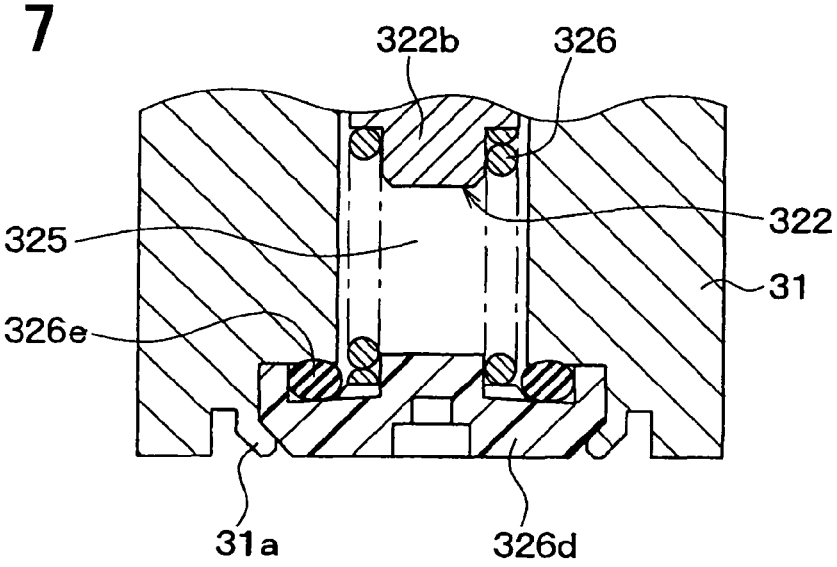
FIG. 7 is a sectional view showing a part of a decompression device according to a fourth embodiment of the present invention.

FIG. 7 is a sectional view showing a part of the decompression device 3, including the spring receiving member 326*d* and the coil spring 326, according to the fourth embodiment of the present invention. As shown in FIG. 7, one end of the coil spring 326 is connected to the valve body 322, and the other end of the coil spring 326 is held in the spring receiving member 326*d* made of a resin. A rubber packing 326*e* is inserted between the body portion 31 and the spring receiving member 326*d*. Protrusion pieces 31*a* provided in the body portion 31 are plastically deformed to be pressed to the spring receiving member 326*c*, so that the spring receiving member 326*d* is fastened to the body portion 31.

According to the present embodiment, by only fastening the spring receiving member 326*d* to the body portion 31, the end of the coil spring 326 opposite to the valve body 322 can be held. Therefore, the valve body 322 can be attached with a simple structure. In the fourth embodiment, the other parts are similar to those of the above described first embodiment, and the effects of the above-described first embodiment can be obtained.

(Fifth Embodiment)

Next, a fifth embodiment of the present invention will be described with reference to FIG. 8. In the fifth embodiment, the structure of a downstream throttle portion 34 is changed, as compared with the above-described first embodiment.

Figure 8:
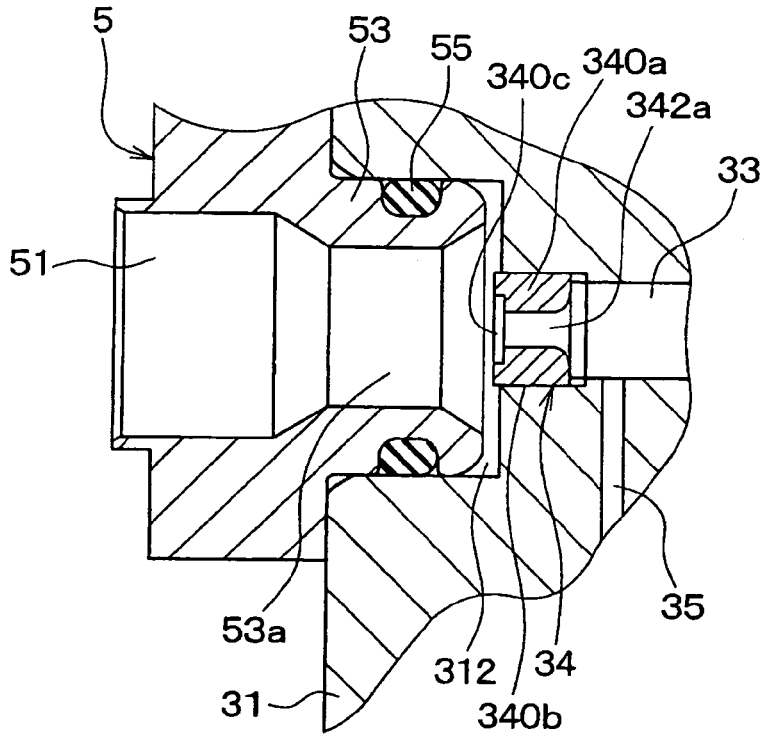
FIG. 8 is a sectional view showing a downstream throttle portion of a decompression device according to a fifth embodiment of the present invention.

FIG. 8 is a sectional view showing a part of a decompression device 3, including the downstream throttle portion 34, according to the fifth embodiment of the present invention. As shown in FIG. 8, a downstream throttle-passage forming member 340*a* defining a downstream throttle passage 342*a* is attached to an end portion of the middle passage portion 33 at a position adjacent to the first outlet 312. The downstream throttle passage 342*a* is formed into a nozzle shape.

A screw portion 340*b* is provided on an outer peripheral surface of the downstream throttle-passage forming member 340*a* to be screw-connected with the body portion 31. A hexagon hole 340*c* is formed in the end surface of the downstream throttle-passage forming member 340*a*, on a side of the first outlet 312. A hexagon wrench or the like is fitted with the hexagon hole 340*c* when the downstream throttle-passage forming member 340*a* is screw-connected with the body portion 31.

According to the fifth embodiment, the downstream throttle-passage forming member 340*a* forming the downstream throttle passage 342*a* is screw-connected to the body portion 31, thereby forming the downstream throttle portion 34. Therefore, the downstream throttle portion 34 can be provided with a simple structure.

In the fifth embodiment, the other parts may be similar to those of the above-described first embodiment, and the effects of the above-described first embodiment can be obtained.

(Sixth Embodiment)

Next, a sixth embodiment of the present invention will be described with reference to FIG. 9. In the sixth embodiment, the downstream throttle-passage forming member 340 described in the first, embodiment is omitted, but a downstream throttle passage 53*b* is directly formed within a first protrusion portion 53 of a attachment block 5.

Figure 9:
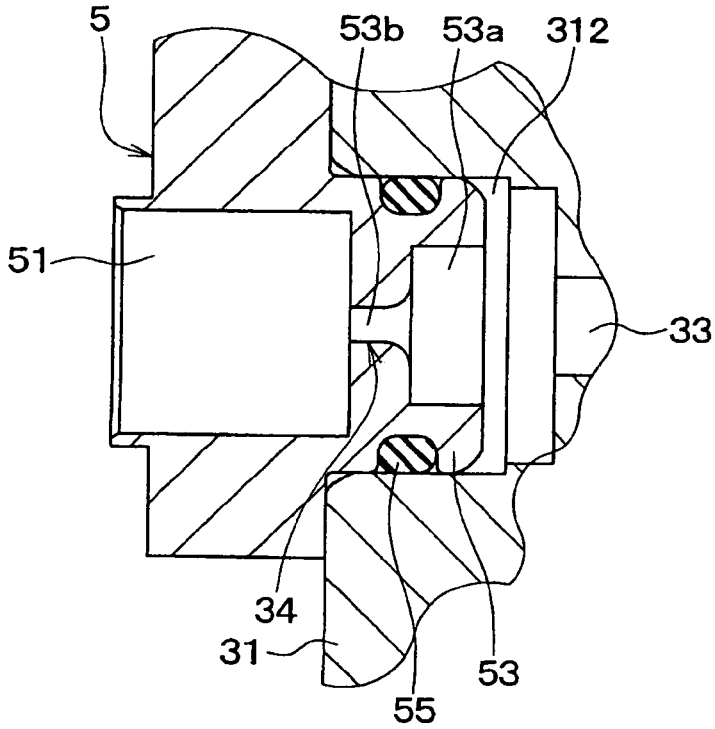
FIG. 9 is a sectional view showing a downstream throttle portion of a decompression device according to a sixth embodiment of the present invention.

FIG. 9 is a sectional view showing a part of a decompression device 3, including a downstream throttle portion 34, according to the sixth embodiment of the present invention. As shown in FIG. 9, the first protrusion portion 53 of the attachment block 5 is inserted into the first outlet 312 of the body portion 31, thereby arranging the downstream through passage 53*b* in the body portion 31. In this case, the first outlet 312 of the body portion 31 is adapted as an insertion hole into which the first protrusion portion 53 is inserted.

A first through hole 53*a* is formed directly within the first protrusion portion 53 to define a downstream refrigerant passage through which the refrigerant flowing out of the middle passage portion 33 flows. Furthermore, the throttle passage 53*b* is provided in the first through hole 53*a* to decompress and expand the refrigerant flowing out of the middle passage portion 33. In the example of FIG. 9, the throttle passage 53*b* is located at a downstream side in the first through hole 53*a*, within the first protrusion portion 53. The throttle passage 53*b* is formed into a nozzle shape as a fixed throttle, and is arranged in the body portion in a state where the body portion 31 is attached to the attachment block 5.

According to the sixth embodiment, the downstream throttle-passage forming member 340 is omitted, while the downstream throttle passage 53*b* is provided within the first protrusion portion 53 of the attachment block 5. Therefore, the downstream throttle portion 34 can be provided with a reduced component number and with a simple structure.

In the sixth embodiment, the other parts may be similar to those of the above-described first embodiment, and the effects of the above-described first embodiment can be obtained.

(Other Embodiments)

Although the present invention has been fully described in connection with the preferred embodiments thereof with reference to the accompanying drawings, it is to be noted that various changes and modifications will become apparent to those skilled in the art.

Figure 10:
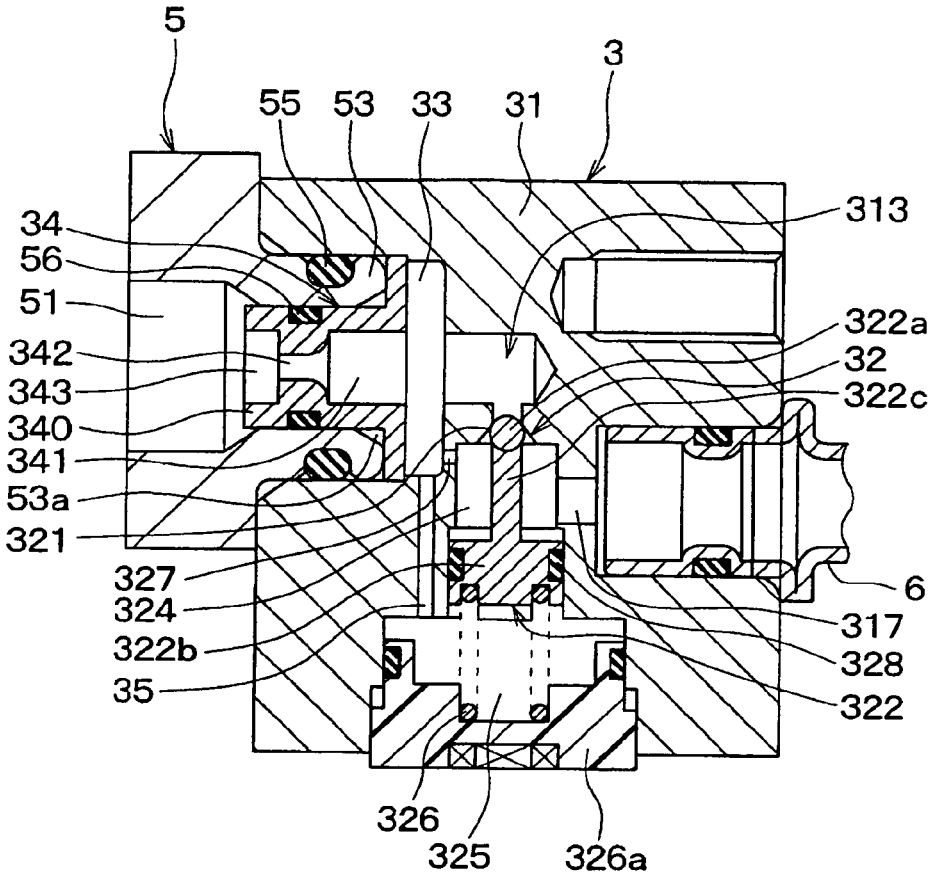
FIG. 10 is a sectional view showing a decompression device according to a modification of the embodiment of the present invention.

(1) In the above-described embodiments, the second inlet 314, the second outlet 315 and the second refrigerant passage 316 are provided in the body portion 31, so that the low-pressure refrigerant flowing out of the evaporator 13 flows into the inlet side of the accumulator 4 through the second refrigerant passage 316. However, the second inlet 314, the second outlet 315 and the second refrigerant passage 316 may be not provided in the body portion 31 as shown in FIG. 10, and may be provided outside of the body portion 31. For example, the refrigerant outlet of the evaporator 13 may be connected to the refrigerant inlet of the accumulator 4 by using a piping provided separately from the body portion 31.

(2) In the above-described first, fourth to sixth embodiments, the O-ring 328 made of a rubber material is located between the inlet-side pressure chamber 324 and the middle-side pressure chamber 325 of the upstream throttle portion 32, as a seal member, to be respectively sealed from each other. However, as the seal member, a resinous piston ring may be used instead of the O-ring 328. Alternatively, by sufficiently setting a length (seal length) of the sliding portion of the valve body 322 between the partition portion 322*b* and the valve chamber 323, it can prevent the refrigerant from being leaked from the sliding portion.

(3) In the above-described embodiments, the downstream throttle passage 342, 342*a* of the downstream throttle portion 34 or the throttle passage 53*b* is formed into a nozzle shape; however, may be formed into an orifice shape or other fixed throttle shape generally known.

(4) in the above-described first to fifth embodiments, the downstream throttle-passage forming member 340, 340*a* is attached to the body portion 31, to define the downstream throttle portion 34. However, the downstream throttle portion 34 may be directly provided within the body portion 31 by directly providing a hole in the body portion 31.

(5) The above described embodiments may be suitably combined if there is no contradiction therebetween.

Such changes and modifications are to be understood as being within the scope of the present invention as defined by the appended claims.

What is claimed is:

1. A decompression device for decompressing a high-pressure refrigerant of a refrigerant cycle, the decompression device comprising:

a body portion having a block shape;

an upstream throttle portion provided in the body portion at an upstream side of a refrigerant flow;

a middle passage portion provided in the body portion at a downstream side of the upstream throttle portion such that the refrigerant having passed through the upstream throttle portion flows through the middle passage portion;

a downstream throttle portion arranged as a fixed throttle in the body portion at a downstream side of the middle passage portion such that the refrigerant having passed through the middle passage portion flows into the downstream throttle portion, wherein a refrigerant passage defined from the upstream throttle portion to the downstream throttle portion through the middle passage portion has at least a bent portion in which the refrigerant flow is bent, the upstream throttle portion includes an upstream throttle passage in which the refrigerant is decompressed and expanded, and a valve body having an open degree adjusting portion configured to adjust an open degree of the upstream throttle passage, the upstream throttle portion is configured by a variable throttle having a valve chamber in which the valve body is slidably accommodated, the valve body is provided with a partition portion that divides the valve chamber into an inlet-side pressure chamber and a middle-side pressure chamber, the inlet-side pressure chamber is provided to communicate with an inlet side refrigerant passage and the upstream throttle passage so that the refrigerant from the inlet side refrigerant passage flows into the upstream throttle passage through the inlet-side pressure chamber, the middle-side pressure chamber communicates with the middle passage portion through a pressure equalization portion such that the refrigerant flows into the middle-side pressure chamber from the middle passage portion, and the valve body is configured to cause the partition portion to be displaced in accordance with a pressure difference between the inlet-side pressure chamber and the middle-side pressure chamber, so that the open degree adjusting portion adjusts the open degree of the upstream throttle passage.

2. The decompression device according to claim 1, further comprising a downstream throttle-passage forming member defining therein a downstream throttle passage in which the refrigerant is decompressed and expanded, wherein the downstream throttle-passage forming member is attached to the body portion to configure the downstream throttle portion.

3. The decompression device according to claim 1, wherein the body portion directly defines therein a downstream throttle passage in which the refrigerant is decompressed and expanded, thereby configuring the downstream throttle portion.

4. The decompression device according to claim 1, wherein the body portion is attached to an attachment member to be attached, the attachment member includes a protruding portion protruding to the body portion, the body portion has therein an insertion hole at a downstream side of the middle passage portion, and the protrusion portion of the attachment member is inserted into the insertion hole, the protrusion portion of the attachment member has therein a refrigerant passage through which the refrigerant flowing out of the middle passage portion flows in a state where the protrusion portion is inserted into the insertion hole, the refrigerant passage provided in the protrusion portion is provided with a protrusion-side throttle passage in which the refrigerant is decompressed and expanded, and the downstream throttle portion is configured by the protrusion-side throttle passage.

5. The decompression device according to claim 1, further comprising a film seal member disposed in the valve chamber at a side of the middle-side pressure chamber of the valve body to seal the inlet-side pressure chamber and the middle-side pressure chamber from each other, and a support member disposed to contact an outer peripheral portion of the seal member on a side of the middle-side pressure chamber, and fixed to the body portion, wherein the seal member is inserted between the body portion and the support member.

6. The decompression device according to claim 1, further comprising a circular seal member disposed between an inner peripheral wall surface of the body portion defining the valve chamber and an outer peripheral surface of the valve body, to be elastically deformable, wherein the seal member seals the inlet-side pressure chamber and the middle-side pressure chamber from each other.

7. The decompression device according to claim 1, wherein the valve body is divided into a first valve portion and a second valve portion in a sliding direction, the decompression device further comprising a film seal member disposed between the first valve portion and the second valve portion to seal the inlet-side pressure chamber and the middle-side pressure chamber from each other

8. The decompression device according to claim 1, further comprising:

a spring disposed in the middle-side pressure chamber to apply a load to the valve body in a direction closing the upstream throttle passage; and an adjustment screw disposed in the body portion to adjust the load due to the spring.

9. The decompression device according to claim 1, further comprising:

a spring disposed in the middle-side pressure chamber to apply a load to the valve body in a direction closing the upstream throttle passage; and a spring receiving member disposed in the body portion to support an end portion of the spring at a side opposite to the valve body.

* * * * *